US005469606A

United States Patent [19]

Hansen

[11] Patent Number: 5,469,606

[45] Date of Patent: Nov. 28, 1995

[54] CLAMP MEANS FOR JOINING OBJECTS TOGETHER

[76] Inventor: Arne Hansen, P.O. Box 389 N-1301, Sandvika, Norway

[21] Appl. No.: 230,296

[22] Filed: Apr. 20, 1994

Related U.S. Application Data

[63] Continuation-in-part of Ser. No. 962,599, Feb. 11, 1993, abandoned.

[51] Int. Cl.[6] ..... A44B 17/00

[52] U.S. Cl. ..... 24/662; 24/297; 24/683; 411/508

[58] Field of Search ..... 24/662, 616, 614, 24/297, 683; 411/508, 509, 510, 913

[56] References Cited

U.S. PATENT DOCUMENTS

| | | | |
|---|---|---|---|
| 1,477,597 | 12/1923 | Schneider | 24/616 |
| 1,823,229 | 9/1931 | Balbaud | 24/662 |
| 2,251,744 | 8/1941 | Kurath et al. | 24/259 |
| 2,946,612 | 7/1960 | Ahlgren | 24/683 |
| 3,220,558 | 11/1965 | Olsson | 211/74 |
| 3,267,546 | 8/1966 | Kraft | 24/259 |
| 3,551,963 | 1/1971 | Mosher, Jr. et al. | 24/662 |
| 3,916,756 | 11/1975 | Yoda | 24/683 |
| 4,672,723 | 6/1987 | Hughes et al. | 24/297 |
| 4,998,396 | 3/1991 | Palmersten | 52/588 |

FOREIGN PATENT DOCUMENTS

| | | |
|---|---|---|
| 0015268 | 10/1911 | Denmark . |
| 0378851 | 7/1990 | European Pat. Off. . |
| 1400868 | 11/1968 | Germany . |
| 2259252 | 6/1974 | Germany . |
| 0011974 | of 1905 | United Kingdom . |
| 1004132 | 9/1965 | United Kingdom . |
| 1185883 | 3/1970 | United Kingdom . |
| 2092525 | 8/1982 | United Kingdom . |
| 8707223 | 12/1987 | WIPO . |
| 9106436 | 5/1991 | WIPO . |

*Primary Examiner*—Victor N. Sakran
*Attorney, Agent, or Firm*—Ladas & Parry

[57] ABSTRACT

The invention comprises a profile-shaped clamp means wherein one or two inside profile elements (6), shaped as gripping springs, press resiliently against an object which is thereby retained. When the object is constituted by a male part (7,9) adapted to fit the profile element of the female shape of said clamp, the total clamp means can be utilize for locking two objects (10,11) to each other. The clamp means is preferably constructed as a profile in a homogeneous material, and a clamp effect and/or a joint is obtained without use of tools or small parts. The profile elements are preferred to be convexly curved, while the male part may be substantially complementary to the curved profile.

13 Claims, 2 Drawing Sheets

CLAMP MEANS FOR JOINING OBJECTS TOGETHER

This application is a continuation-in-part of U.S. Ser. No. 07/962,599 filed Feb. 11, 1993, now abandoned.

The present invention generally concerns a clamp means, which comprises two parts adapted to join together two objects. Said clamp means preferably has a profiled shape, i.e. it is more or less elongated in shape.

Several related clamp means are previously known, and the most common in this respect are clamps with elastic U or inverse shapes which surround parts of an object which is pushed into the clamp. Ordinary two-part buttons of the snap-fastener type, often used in garments, exhibit a principle which is related to the present invention.

However, such a snap-fastener operates only in accordance with an elastic principle, and is released by pulling the male part of the button right out again by use of sufficient power, in order to overcome the elasticity in a "retainer spring part" in the female part of the snap-fastner.

However, there exists an obvious need of a clamp means of a substantially stronger type than the above mentioned types, which clamp means may provide the advantage that two objects can be joined together instantaneously to create a very strong unit, and possibly including the opportunity of a release mechanism which can be realized in a simple manner.

The purpose of the invention, namely the strong joining together of two objects, is achieved by providing a preferably profile-shaped clamp means for fast and simple ("snap") joining together of two objects. Each object is provided with respectively a male part and a female part of said clamp means, and these parts have front ends substantially facing each other prior to joining by inserting one part into the other. The front ends have forward-facing front surfaces, with one of the parts comprising in cross section at least one springy, barb-like profile element attached to its front end for providing a retaining effect for the other part when joining the two objects. The other part has a shoulder section at its front end, and the profile element or elements is/are adapted to yield elastically sideways when the two objects engage, due to said shoulder section, and thereafter to relax and return quickly to a less strained position when the shoulder section and the profile element or elements have passed each other. The shoulder section has such dimensions that said shoulder section and the profile element or elements retain each other mutually due to a barb effect at the profile element edge(s) and due to a contact pressure between the front surface (s) of the other part and (an) engaging surface (s) at the profile element part. A further clamping effect is also obtained due to a pinch effect between the profile elements and opposite surface(s) of the other part. The particular characteristics of the clamp means are that the profile element or elements is/are convexly curved when viewed from the other part, that the profile element or elements extend(s) substantially along the female part cavity walls in the insertion direction, and that the surface of the other part located adjacent the shoulder section has a substantially complementary cross-sectional shape in relation to the profile element or elements all along the extent thereof when the profile element or elements is/are in its/their less strained position, in order to obtain a firm and rigid engagement.

In one embodiment of the present invention, the surface adjacent the shoulder section, is complementary to the profile element surface for some distance along the profile direction.

In certain embodiments, the clamp means is relatively elongate in the profile direction.

In a preferred embodiment of the clamp means, one part has two oppositely arranged profile elements, placed symmetrically and for a symmetrical effect in relation to a center plane, said other part also being correspondingly symmetrically shaped behind its shoulder section for a double complementary engagement effect against the two profile elements when in their less strained positions.

In a very favourable embodiment of the clamp means, one part has a tapered forward section which fits complementarily into a correspondingly shaped recess in the other part, for further support effect.

In most embodiments of the clamp means in accordance with the present invention, it is important that it can be released in a simple manner, and one embodiment of the clamp means is that it is typically long in the profile direction and comprises one or several sections without profile elements in the one part thereof, and with corresponding sections in offset positions in the other part without shoulder sections providing the barb effect, in such a manner that the two parts can be released by a relative displacement along the longitudinal direction, until no locking/holding effect is present.

In another embodiment of the most generally stated clamp means specified above, a female part has two oppositely arranged profile elements, placed symmetrically and for symmetrical effect in relation to a central plane spanned by an axis which is parallel to the longitudinal direction of the clamp means along said upper edge, and by the insertion direction for the male part into the cavity, while the male part is shaped rotation symmetrically about an axis in the insertion direction, and has a surface adjacent said shoulder section which is substantially complementary to the cross-section shape of the two profile elements when in their less strained positions, for achieving a double complementary engagement effect along the curves of contact.

The present invention provides a simple joining together of two objects by pushing these objects toward each other. The two objects are also separated in an equally simple manner, if this is a desirable embodiment, by mutual displacement along the joining profiles being equipped with sections without profile elements, or by retracting the profile elements sideways.

In the following, the invention will be described more closely by means of examples, and with reference to the enclosed drawing figures, where FIG. 1 shows the clamp means in an embodiment as a joining means for two objects, FIG. 2A–2C show a more advanced and releasable embodiment in accordance with the invention, and FIG. 3 shows a detail embodiment of central elements of the invention.

Figure 1:
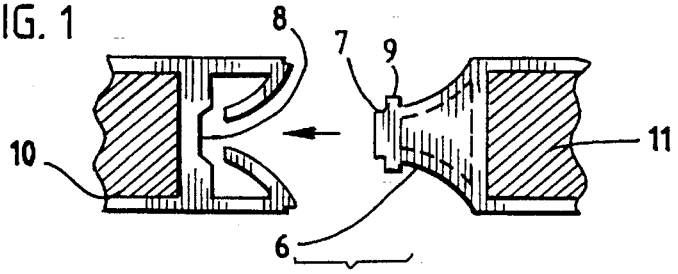

FIG. 1 shows a cross section through profile-shaped objects 10 and 11 which are provided with respectively a female part and a male part of a profile-shaped clamp means. The female part of the clamp means is in this embodiment example constructed integrally with the object 10, the female part bottom being provided with a recess 8 and being of a symmetrically shaped type with two profile elements or springs 6 with a convexly curved shape when viewed from the opposite part, and this female part is adapted to receive a male part with substantially complementary shape. This male part is in a corresponding manner designed as a part of the object 11 which shall be locked to object 10. The locking operation is made in a very simple manner in this case, by moving the two objects 10 and 11 right toward each other, the elasticity of the profile elements 6 causing these profile elements to yield sidewise, allowing the tip having a tapered section 7 complementary shape with said recess 8, to penetrate to the bottom of the female part. The two profile elements 6 slip back to a less strained position immediately when tip 9 has passed by, and a joining connection with a very large engagement surface is obtained. When the material dimensions have been machined with sufficient precision, this joint will be very strong, with good rigidity in all directions. Such a joint clamp means can provide both temporary and permanent connection of two objects.

The female and the male parts of the clamp means must not necessarily be integrally constructed with the objects to be fastened together, but may equally well be screwed separately on to each respective object.

However, in its most general form, this clamp means is not necessarily equipped with two symmetrical profile elements, and nor must the surfaces be completely complementary designed. The importance and quite essential feature is that one part has at least one convexly curved profile element, attached along the front edge, and in such a manner that it extends substantially along the female part cavity walls in the insertion direction, that the profile element is elastic, and that the shoulder section has dimensions adapted to provide a barb effect and also an engagement effect between profile element end and an opposite surface on the other part. The two parts are then retained in three simultaneous manners, namely by the profile element providing a substantially lateral pinch effect, by said profile element operating as a barb, and by an engagement effect established between the profile element end and an opposing surface in the insertion direction.

Of course it is possible to utilize such a clamp means as the type shown in FIG. 1 to make a permanent joint. One may then simply envisage a female and a male part being quite uniform along the total profile length, and that blocking means are provided, so that the two parts cannot be shifted along each other.

On the other hand, if such a longitudinal displacement is possible along the whole profile length, it will of course be possible to release the male part and the female part from each other in this manner. However, if one is dealing with typically long objects, it will be favourable to provide both male part and female part with sections without interlocking shoulder sections 9 and profile elements 6. With such sections intercalated in suitable positions, male and female parts can be pulled apart after only a short longitudinal relative displacement.

In the clamp means shown in FIG. 1, the male part at the right in the drawing may also have a rotation symmetrical shape, about an axis in the same direction as the arrow. Such an embodiment is of course not as strong as that embodiment which utilizes a longitudinal profile shape also regarding the male part, however also such a joint clamp means will exhibit a certain degree of rigidity against bending "out of the paper plane", even though the complementary engagement between the two parts in such a case actually only takes place along two curves of contact. However, such a means may have clear advantages within the art of building constructions.

Figure 2A:
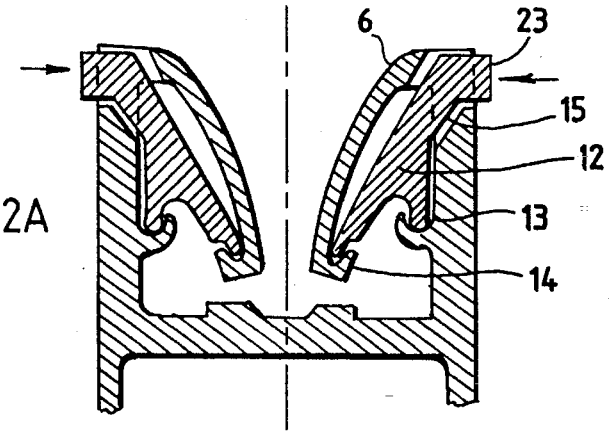
Figure 2B:
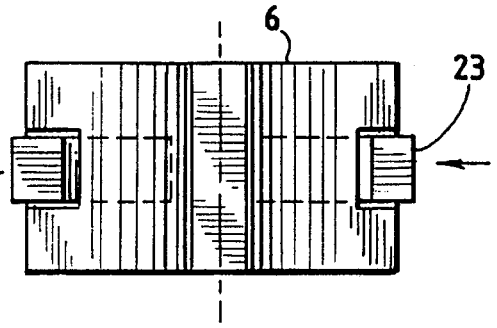

In FIGS. 2A and 2B there is shown a more advanced embodiment of the invention. As appears most clearly from FIG. 2B, showing a female part in a view from above, i.e. one views down into the cavity, holes are provided on both sides on the top at the edges of the female part walls. A lever 12 is arranged behind each profile element 6. The lower edge of each profile element 6 is attached to a lever 12 having an end part 23.

As indicated with arrows in both FIGS. 2A and 2B, it is possible to push or squeeze the lever end parts 23, to the effect that the edges of the profile elements move sideways and out. Thereby the two parts can be released by pulling directly outwards.

Figure 2C:
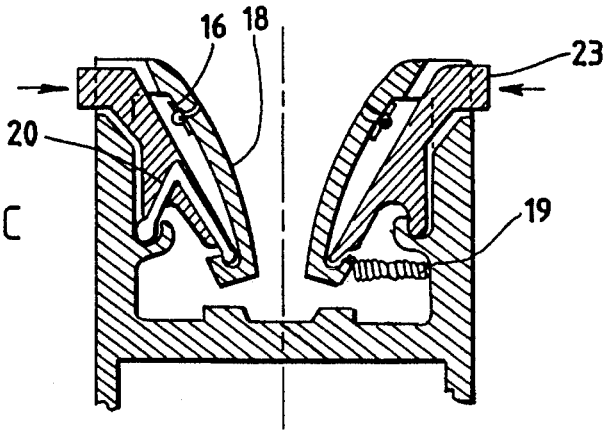

A further variant of the same principle can be found in FIG. 2C. In this case, which as a starting point is the same as that shown in FIGS. 2A and B, the elasticity of the system is provided by means of an articulation, examplified as hinge 16, and alternative spring means 19 or 20 (those shown in the same FIG. 2C on respective sides) mounted on the profile element, providing the same release possibility as in the previous case. This solution may be of particular interest regarding embodiments of the clamp means with higher rigidity and/or larger dimensions.

Figure 3:
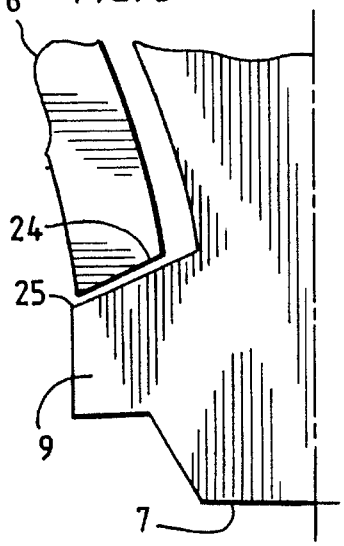

FIG. 3 shows a detail embodiment of central elements of the invention, and illustrates how the curved profile element 6 on the one part may interface with the shoulder section 9 and adjacent area on the other part, in order to obtain at the same time a barb effect and a lateral pinch effect, and how the one part may be provided with a tapered section 7 which fits complementary into a correspondingly shaped recess 8 in the other part for further support effect.

Figure 4A:
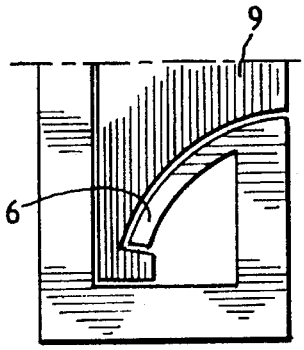
FIGS. 4A and 4B shows another embodiment illustrating the two parts of the clamp means in completely complementary manner.

FIG. 4A shows the embodiment of only one profile of the female part 6 extending downward within a cavity. The male part 9 has a completely complementary shape with the convexly curved profile.

Figure 4B:
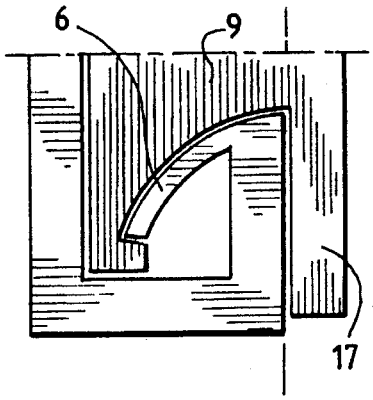

It can be understood that FIG. 4B is a variant of the embodiment of FIG. 4B. The male part thereof includes an extended portion 17.

Figure 5:
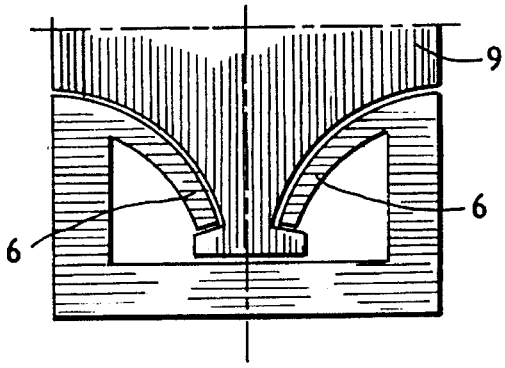
FIG. 5 shows an alternative embodiment of FIG. 4 including two symmetrical profile elements.

FIG. 5 is similar with FIG. 1. However, the male part 9 has a completely complementary shape with the symmetrical curved profiles of the female part 6.

Figure 6:
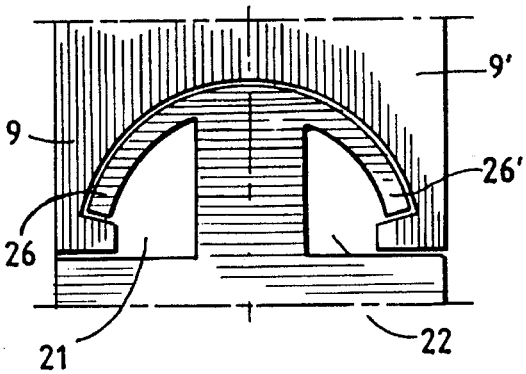
FIG. 6 illustrates still another embodiment including two of the embodiments shown in FIG. 4A reversely set and connected with one another.

FIG. 6 illustrates two female parts, such as the one shown in FIG. 4A, reversely integrally formed with one another. That is the two curved profiles 26 and 26' point away from each other and extend downwardly respectively into two cavities 21 and 22. The male parts 9 and 9' are also reversely joined with one another. Because of such reverse connection, the embodiment of FIG. 6 can also be understood to have male and female parts of FIG. 4A transfored from one another. Thus, the parts of the curved profiles form a new male part, while the parts of the lateral shoulders define a new female cavity matching the curved profiles. Notwithstanding, as described before, this unique embodiment can still be viewed as reversely joined two embodiments of FIG. 4A.

Figure 7:
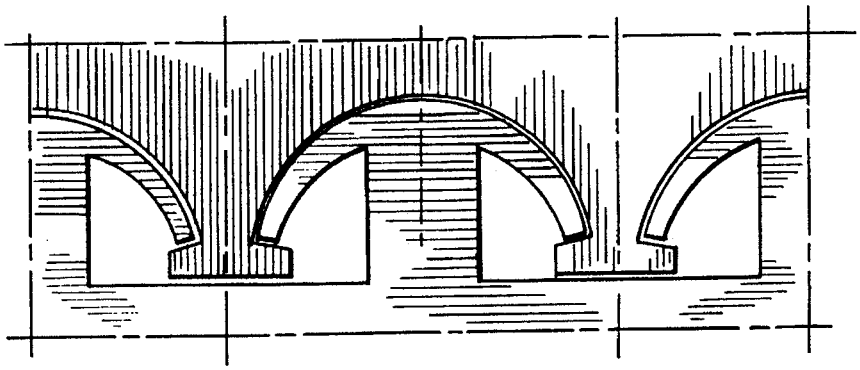
FIG. 7 is still further another embodiment as a variant of FIGS. 4–6.

Such transformation can be further understood from the embodiment shown in FIG. 7. For instance, when the central portion of the embodiment of FIG. 7 is isolated from the two side portions, the central portion will be identical with the one shown in FIG. 6. However, it can also be deemed as two embodiments of FIG. 5 joined together.

I claim:

1. A clamp means, preferably with a profile-shaped design, for joining together two objects in a fast and simple snap-on manner, comprising a male part and a female part provided respectively for each object, said female part comprising at least one springy, barb-like profile element attached along the upper edge of the female part, and in such a manner that for providing a retaining effect for the male part when the male part is inserted into the female part cavity, said profile element extending down into said cavity and being adapted to yield elastically sideways when the male part is inserted in the cavity and engages a profile element surface, and thereafter to be relaxed and return quickly to a less strained position when the tip of the male part has passed by the profile element, said male part tip having such dimensions that said tip is retained by the profile element due to a barb effect and against the cavity bottom due to an engagement effect, a further clamping effect also being obtained due to a pinch effect between the profile elements or between the single profile element and the opposite wall, said profile element being convexly curved when viewed in the insertion direction, that the lower edge of said profile element is located substantially closer to the cavity bottom than to the upper edge of the wall, a male part section behind said male part tip having a surface with a substantially complementary cross section shape in relation to said profile element surface when the profile element is in its less strained position, in order to obtain a firm and rigid engagement.

2. The clamp means in accordance with claim 1, wherein said male part surface is complementary to said profile element surface for some distance along the profile direction.

3. The clamp means in accordance with claim 1, wherein said clamp means is elongate in a profile direction given by said upper edge of a cavity limiting wall.

4. The clamp means in accordance with claim 1, wherein the lower edge of each respective profile element is shaped, in a cross sectional view, with a straight cut in an inclined direction substantially down toward the adjacent bottom and wall corner in the cavity, and wherein the cross section shape of said male part is complementary to this shape at the rear edge of the tip.

5. The clamp means in accordance with claim 1, said female part comprising in cross section a substantially U-shaped cavity with a bottom and two upright walls, and two oppositely arranged profile elements, wherein said profile elements are placed in a symmetrical manner and for symmetrical effect in relation to a central plane spanned by an axis which is parallel to the longitudinal direction of the clamp means along said upper edge, and by the insertion direction for the male part into said cavity, and wherein said male part also being correspondingly symmetrically shaped behind its tip for a double complementary engagement effect against the two profile elements in their less strained positions.

6. The clamp means in accordance with claim 5, wherein the male part tip has a tapered forward section which fits complementarily into a corresponding shaped recess in the cavity bottom, for further support effect.

7. The clamp means in accordance with claim 5, wherein the lower edge of each profile element has a longitudinally extending part which is curved rearwardly toward the adjacent wall and up, thereby providing a first groove, each respective wall having on the inside thereof arranged a longitudinally extending section which projects inwardly and up at a height between said edge groove and the upper edge of the wall, thereby providing a second groove, and a rigid lever is arranged behind each respective profile element, said lever comprising a first arm with a rim protruding down into said first groove, a support arm in an inclined relation to said first arm, said support arm having an end thereof in engagement with the second groove for providing a pivot axis for said lever, and a second arm in the opposite direction of said first arm, said second arm having an end part projecting out through a hole in the upper edge of the female part, said hole being provided for that purpose, said levers, on both sides of said clamp means, being adapted, when both end parts are pushed or squeezed to bend said profile elements backwards and away from a possibly retained male part, such that said male part is able to be pulled right out of the female part again, the distance from said pivot axis to the squeeze position of an end part being larger than the distance to the first groove, so that the necessary squeeze force is reduced due to a favourable moment arm ratio.

8. The clamp means in accordance with claim 5, wherein both profile elements are articulated along the profile direction with hinges mounted on the backside thereof, the springy effect of the profile elements being provided by separate spring devices mounted between the backside of the respective profile element and the adjacent wall.

9. The clamp means in accordance with claim 1, said female part comprising in cross section a substantially U-shaped cavity with a bottom and two upright walls, and two oppositely arranged profile elements, wherein the profile elements are placed symmetrically and for symmetrical effect in relation to a central plane spanned by an axis which is parallel to the longitudinal direction of the clamp means along said upper edge, and by the insertion direction for the male part into the cavity, and wherein said male part is rotation symmetrically shaped about an axis in the insertion direction, with a surface the cross sectional shape of which in the section behind said tip is complementary to the cross sectional shape of the two profile elements when in their less strained positions and in contact with the male part, for obtaining a double complementary engagement effect along the curves of contact.

10. The clamp means in accordance with claim 9, wherein the male part tip has a tapered forward section which fits complementarily into a correspondingly shaped recess in the cavity bottom, for further support effect.

11. The clamp means in accordance with claim 9, wherein the lower edge of each profile element has a longitudinally extending part which is curved rearwardly toward the adjacent wall and up, thereby providing a first groove, each respective wall having on the inside thereof arranged a longitudinally extending section which projects inwardly and up at a height between said edge groove and the upper edge of the wall, thereby providing a second groove, and a rigid lever is arranged behind each respective profile element, said lever comprising a first arm with a rim protruding down into said first groove, a support arm in an inclined relation to said first arm, said support arm having an end thereof in engagement with the second groove for providing a pivot axis for said lever, and a second arm in the opposite direction of said first arm, said second arm having an end part projecting out through a hole in the upper edge of the female part, said hole being provided for that purpose, and levers, on both sides of said clamp means, being adapted, when both end part are pushed or squeezed to bend said profile elements backwards and away from a possibly retained male part, such that said male part is able to be pulled right out of the female part again, the distance from said pivot axis to the squeeze position of an end part being larger than the distance to the first groove, so that the necessary squeeze force is reduced due to a favourable moment arm ratio.

12. The clamp means in accordance with claim 9, wherein both profile elements are articulated along the profile direction with hinges mounted on the backside thereof, the springy effect of the profile elements being provided by separate spring devices mounted between the backside of the respective profile element and the adjacent wall.

13. A clamp means, preferably with a profile-shaped design, for joining together two objects in a fast and simple snap-on manner, comprising a male part and a female part provided respectively for each object, said male part comprising a pair of springy, barb-like profile elements attached along the upper edge thereof for providing a retaining effect in the female part when the male part is inserted into the female part cavity, said profile elements being adapted to yield elastically inward when the male part is inserted in the cavity and engages a profiled surface of the cavity, and thereafter to be relaxed and return quickly to a less strained position when the male part profile elements have passed by the shoulder of the female part, said shoulder having such dimensions to retain the profile elements against the cavity bottom due to an engagement effect and a barb effect, a further clamping effect also being obtained due to a pinch effect of the profile elements against opposite walls of the cavity, said profile elements being convexly curved when viewed in the insertion direction, that free ends of said profile elements point away from the upper edge thereof, the female cavity having its surface substantially complementary in relation to said profile elements when the profile elements are in their less strained position, in order to obtain a firm and rigid engagement.

* * * * *